United States Patent [19]

Trombly

[11] Patent Number: 4,630,744

[45] Date of Patent: Dec. 23, 1986

[54] CONTAINER WITH REGISTRATION RIB

[75] Inventor: Edgar F. Trombly, Grosse Pointe Farms, Mich.

[73] Assignee: Thermo-Serv, Inc., Anoka, Minn.

[21] Appl. No.: 771,775

[22] Filed: Sep. 3, 1985

[51] Int. Cl.[4] ..... B65D 21/02

[52] U.S. Cl. ..... 220/1 R; 229/1.5 B

[58] Field of Search ..... 220/1 R, 66, 72, 74; 229/1.5 B; 215/1 C

[56] References Cited

U.S. PATENT DOCUMENTS

| | | | |
|---|---|---|---|
| 3,381,849 | 5/1968 | Karlsson | 229/1.5 B |
| 3,484,018 | 12/1969 | Davis | 229/1.5 B X |
| 3,680,763 | 8/1972 | Ludder | 229/1.5 B |
| 3,820,684 | 6/1974 | Harrison | 229/1.5 B X |
| 3,836,042 | 9/1974 | Petitto | 220/72 X |
| 4,197,948 | 4/1980 | Amberg et al. | 229/1.5 B X |

*Primary Examiner*—Steven M. Pollard

*Attorney, Agent, or Firm*—Kenneth J. Hovet

[57] ABSTRACT

The lower sidewall portion of a round container is provided with an exterior rib. The rib provides a positive registration point for silk screening equipment used to apply multi-colored designs on the container sidewalls. The rib extends outwardly from a recessed sidewall and is coextensive with the container axis.

4 Claims, 4 Drawing Figures

CONTAINER WITH REGISTRATION RIB

BACKGROUND OF THE INVENTION

1. Field of the Invention

The present invention relates to decorative containers. More directly, it pertains to improve means on a round container for securing the correct position of the container in equipment that applies decorative designs to container sidewalls.

2. Description of the Prior Art

Equipment that imparts coloring matter to container sidewalls is complex and requires substantial precision in positioning the container. This is especially important when multi-colored designs are used where different colored patterns are overlaid and must be in perfect registry.

Equipment for accomplishing the above with round containers require some type of container indexing means. Prior art containers untilize a notch or recess in the container bottom to indicate a particular position. The decorative operation typically involves rotation of the container while coloring matter is applied to the sidewall. A sensing means detects the notch and stops the coloring process.

A problem with the notched container bottom is that it's close to the container rotational axis. As such, a slight imprecision in stopping the container rotation at the notch becomes magnified at the container outer wall. This results in a misalignment and/or blurring of design outlines.

Also, with high speed, high volume production equipment, the bottom notch requires sensory means that is unduly complicated and extraordinarily expensive.

Still further, it is oftentimes desirable to be able to reverse the rotational direction of the container for certain coloring processes. In such case, an additional bottom notch is required that faces the opposite direction.

Another disadvantage with the prior art notch system is that it detracts from the container appearance. When two notches are used, the container bottom becomes even more unsightly. This is especially evident when clear bottom containers are used.

SUMMARY OF THE INVENTION

The present invention provides a reliable and effective means for precisely indexing the rotational location of a round container in a sidewall coloring or printing apparatus. Said means comprises an exterior projection located on a lower side-wall of the container. By enlarging the distance from the rotational axis of the container, maximum control of the indexing operation will result. Further, the container bottom is left clear and unobstructed. Also, container indexing is more readily controlled from either forward or reverse directions.

DESCRIPTION OF THE PREFERRED EMBODIMENTS

Figure 1:
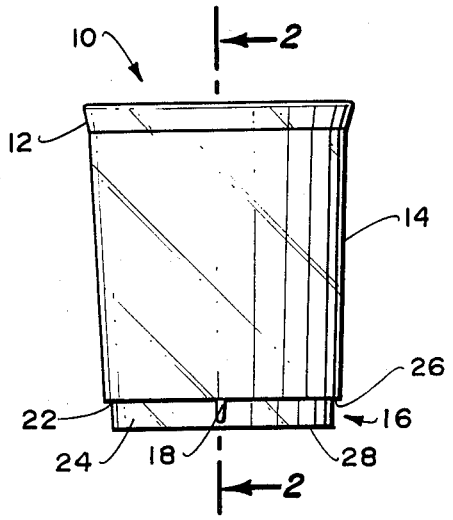
FIG. 1 is a side elevational view of a container with registration rib in accordance with the present invention.
Figure 2:
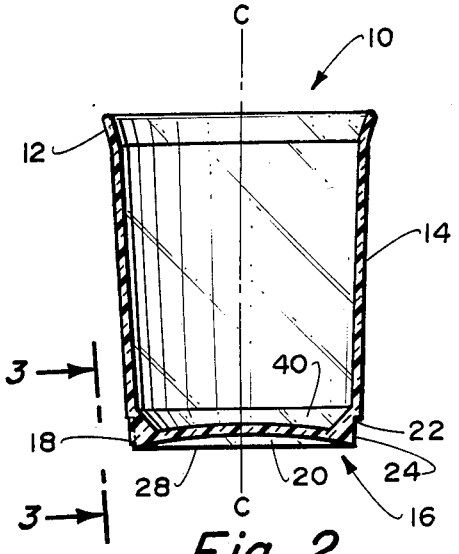
FIG. 2 is a cross-sectional view taken along lines 2—2 of FIG. 1.
Figure 3:
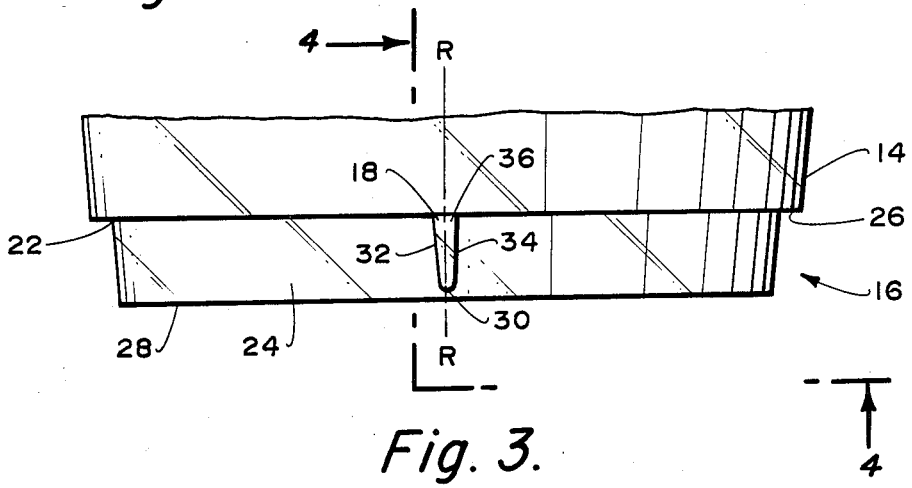
FIG. 3 is an enlarged fragmentary view of the lower portion of the container taken along lines 3—3 of FIG. 2.

With reference now to the drawings, a round container is shown by reference numeral 10. The container is provided with a flared upper lip portion 12 that merges into inwardly inclined sidewall 14. The sidewall and lip portion have a uniform thickness throughout.

The exterior of the sidewall includes a lower portion 16 having an offset sidewall 24 set inwardly from wall 14 by shoulder 26. The offset sidewall extends from an upper end at inner corner 22 to a lower end 28. The lower end defines the outer periphery of base 20. Although the offset sidewall may be vertical, it is shown as inclining inwardly in a manner coextensive with the main body sidewall 14.

Extendiing outwardly from the offset sidewall is projection 18. Preferably, the projection is an elongated member extending from shoulder 26 downwardly to a terminus 30 proximate lower end 28. The projection includes opposing wall surfaces 32, 34 that extend outwardly from the offset sidewall a distance sufficient to interact with the indexing sensory apparatus utilized to effect sidewall coloring or printing.

Figure 4:
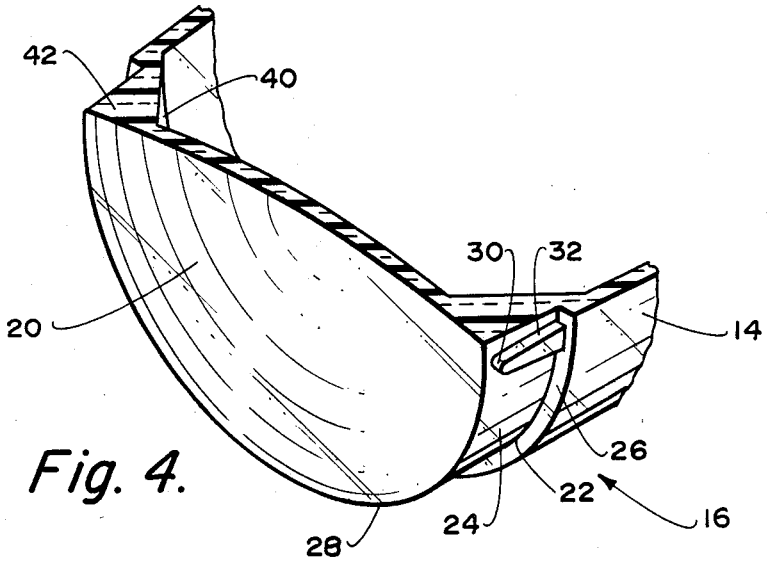
FIG. 4 is a cross-sectional view taken along lines 4—4 of FIG. 3.

As best shown in FIG. 4, the projection extends outwardly a distance less than the width of shoulder 26 and includes an outer face 36. As so defined, the projection may be connoted as a rib having a longitudinal axis R,R that extends vertically with respect to the offset sidewall and is coextensive with the rotational axis C,C of the container. Such alignment further facilitates precision indexing of the container during the design application process.

It is expected that the container will be constructed of a moldable material such as plastic or glass. In such case, the lower interior portion of the container includes an inclined surface 40 that merges into the base 20. In this manner, an annular thickened region 42 is formed about the container lower portion. This results in a well-balanced, weighted container giving the user a sense of strength and stability. It also facilitates formation of rib 18 within the annular recess of lower sidewall portion 16.

While the projection 18 is shown as having opposing wall surfaces 32,34 inclining toward terminus 30, it will be understood that a rectangular or square-shaped elongated member may also be utilized to effect the objectives of the invention. Also, with the projection set within the recessed lower sidewall portion, its appearance is innocuous and will not detract from the overall attractiveness of the container and any sidewall design imparted thereto.

It will further be appreciated that base 20 is convex when viewed from the container interior. In this way, the bottom surface will be upraised and out of contact with surfaces that may otherwise cause unsightly scratches and the like. Of course, a recessed bottom is not possible with the prior art bottom notch indexing system.

While the invention has been described with respect to a preferred embodiment, it will be apparent to those skilled in the art that other modifications may be made without departing from the scope and spirit of the invention. Accordingly, it is to be undersood that the invention is not to be limited by the aforesaid embodiment, but only by the scope of the appended claims.

I claim:

1. A container having a base from which extends a sidewall with a lower portion comprising an annular shoulder defining an inner corner from which an offset sidewall extends downwardly to a lower end defining the outer periphery of said container base, said offset sidewall including a single elongated rib exterior member extending from said inner corner downwardly to a terminus proximate said lower end with the longitudinal axis thereof coextensive with the rotational axis of said container wherein the lower portion interior of said container comprises an annular inclined surface intersecting and extending inwardly from the container sidewall to said base forming a thickened region about the base periphery.

2. The container of claim 1 wherein said member is defined by opposing wall surfaces extending about perpendicular from the offset sidewall.

3. The container of claim 2 wherein said wall surfaces extend from the offset sidewall a distance less than the width of said shoulder.

4. The container of claim 1 wherein said base is convex when viewed from the container interior.

* * * * *